US005738553A

United States Patent [19]

Pilotti

[11] Patent Number: 5,738,553

[45] Date of Patent: Apr. 14, 1998

[54] CLAMP FOR CONNECTING THE POLES OF A BATTERY

[76] Inventor: Gianluigi Pilotti, Via Roma, 31, 15023 Felizzano (Alessandria), Italy

[21] Appl. No.: 643,579

[22] Filed: May 6, 1996

[30] Foreign Application Priority Data

Nov. 22, 1995 [IT] Italy ..... MI950806 U

[51] Int. Cl.[6] ..... H01R 4/42

[52] U.S. Cl. ..... 439/763

[58] Field of Search ..... 439/761–764, 439/882

[56] References Cited

U.S. PATENT DOCUMENTS

| | | | |
|---|---|---|---|
| 1,421,355 | 6/1922 | Walker | 439/764 |
| 2,685,076 | 7/1954 | Hoffman | 439/882 |
| 4,242,535 | 12/1980 | Defibaugh et al. | 439/882 |
| 4,353,726 | 10/1982 | Kato et al. | 439/763 |
| 4,692,122 | 9/1987 | Montalbano | 439/882 |
| 5,316,505 | 5/1994 | Kipp | 439/764 |
| 5,454,741 | 10/1995 | Okada | 439/762 |
| 5,547,403 | 8/1996 | Haberstroh et al. | 439/763 |
| 5,558,545 | 9/1996 | Staab et al. | 439/762 |

*Primary Examiner*—Neil Abrams
*Assistant Examiner*—Katrina Davis
*Attorney, Agent, or Firm*—Bucknam and Archer

[57] ABSTRACT

The present invention relates to a clamp for connecting the poles of a battery, the clamp being made of a cold-pressed brass material, so as to fit all the functional type of requirements while alleviating the environmental problems related to the making and use of the clamp.

3 Claims, 2 Drawing Sheets

CLAMP FOR CONNECTING THE POLES OF A BATTERY

BACKGROUND OF THE INVENTION

The present invention relates to a clamp for connecting the posts of storage batteries.

As known, prior clamps for connecting the posts of batteries, in particular in motor vehicles, are conventionally made of lead.

While these lead clamps have electric and mechanical characteristics suitable for such an application, lead is, however, a greatly polluting material and its use is increasingly forbidden.

SUMMARY OF THE INVENTION

Accordingly, the aim of the present invention is to provide a clamp construction, which has suitable electric and mechanical characteristics, while having a very reduced environmental impact.

Within the scope of the above mentioned aim, a main object of the present invention is to provide such a flexible clamp construction which can be indifferently used either for the negative or for the positive post of the battery.

Another object of the present invention is to provide such a clamp construction which can be bilaterally assembled and which allows electric cables to easily pass on the top portion of the battery.

According to one aspect of the present invention, the above mentioned aim and objects, as well as yet other objects, which will become more apparent hereinafter, are achieved by a clamp for connecting the posts of a battery, characterized in that said clamp is made of a cold-pressed brass material.

BRIEF DESCRIPTION OF THE DRAWINGS

Further characteristics and advantages of the clamp construction according to the present invention will become more apparent hereinafter from the following detailed disclosure of a preferred embodiment of the subject clamp which is illustrated, by way of an indicative, but not limitative, example, in the figures of the accompanying drawings, where.

DESCRIPTION OF THE PREFERRED EMBODIMENT

Figure 2:
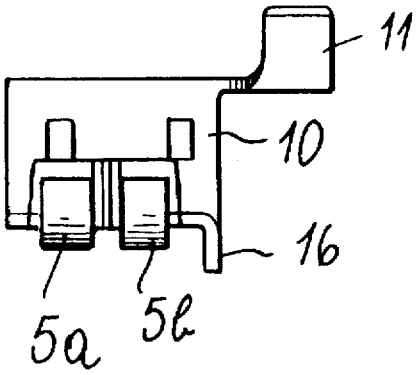
FIG. 2 is a front elevation view of the clamp shown in FIG. 1.
Figure 1:
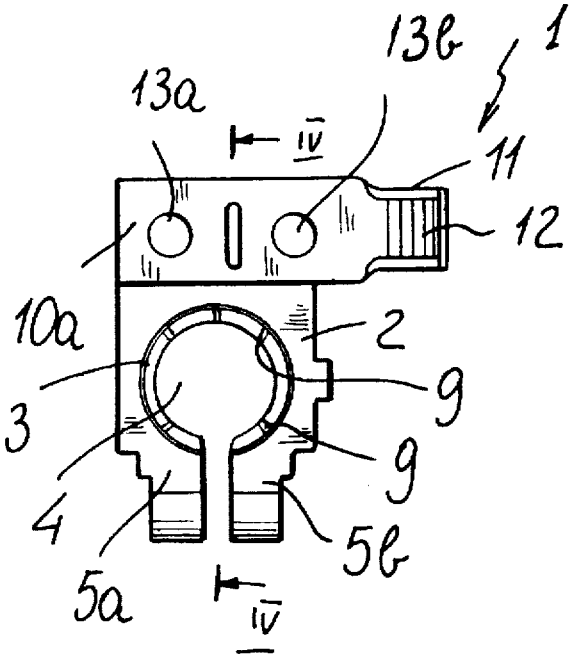
FIG. 1 is a top plan view of the clamp construction according to the present invention.
Figure 4:
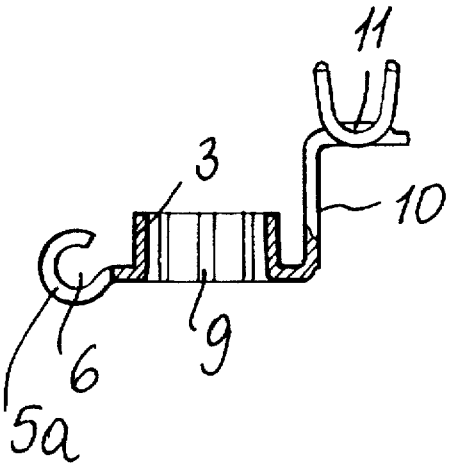
FIG. 4 is a partially cross-sectioned side elevation view of the clamp of FIG. 1, substantially taken along the section line IV—IV of FIG. 1.
Figure 3:
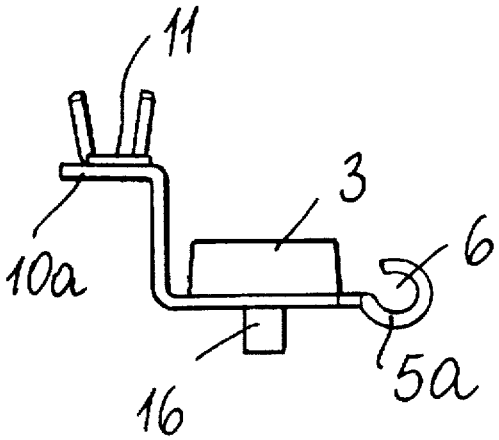
FIG. 3 is a further side elevation view of that same clamp.

With reference to the number references of the above mentioned figures, the clamp construction according to the present invention, which has been generally indicated by the reference number 1, is made by shearing and cold pressing a tinned brass plate, preferably galvanized brass, for example the brass material OT67, OT70 according to the UNI 4894 Standard Table.

The tin coating has preferably a thickness of 7 microns.

The subject clamp construction is provided with a substantially flat central portion 2 therefrom extends a substantially frustum of cone shaped mantle 3, defining a recess or seat 4 for receiving the pole or post of the battery.

The frustum of cone shaped mantle 3 extension is cut off at a set portion thereof, therefrom two facing legs 5*a* and 5*b* extend, which are so contoured as to define a passage 6 for a bolt 7 provided for clamping the clamp construction about the post 8 of the battery 15.

On the inner surface of the mantle 3, i.e. on the surface thereof provided for engaging with the pole or post 8 of the battery, are defined a plurality of coined portions 9, which are evenly spaced from one another.

The clamp construction according to the present invention comprises moreover, on the opposite side from the clamping bolt 7, a contoured leg 10, extending from the central portion 2 preferably up to a level higher than the top end portion of the mantle 3, with a portion 10*a* thereof on which a latching portion 11 is formed.

This latching or clamping portion 11 is provided for receiving electric cables, of different cross sections, typically from 10 to 35 $mm^2$.

In this connection it should be pointed out that the clamping of the electric cable in the clamping or latching portion 11 is advantageously performed only on the inner leg, without the need of providing on the clamp additional fins, for also clamping the insulating material.

This will allow to greatly reduce the making cost, weight and size, so as to easily allow the clamp to be assembled, bilaterally or in two directions, on the novel standardized batteries, which were recently standardized according to the DIN Standards.

On the surface of the clamping portion 11 provided for contacting the electrically conductive part of the electric cable are defined a plurality of coined portions 12.

Moreover, on the portion 10*a* are provided throughgoing holes 13*a* and 13*b*, which can be used for connecting, for example by using bolts 14, the terminals of cables for power supplying additional services.

The overlaying position of the portion 10*a* of the leg 10 will allow both the cables connected to the clamping portion 11 and the cables for power supplying auxiliary services, to pass through the top portion of the battery 15.

Figure 8:
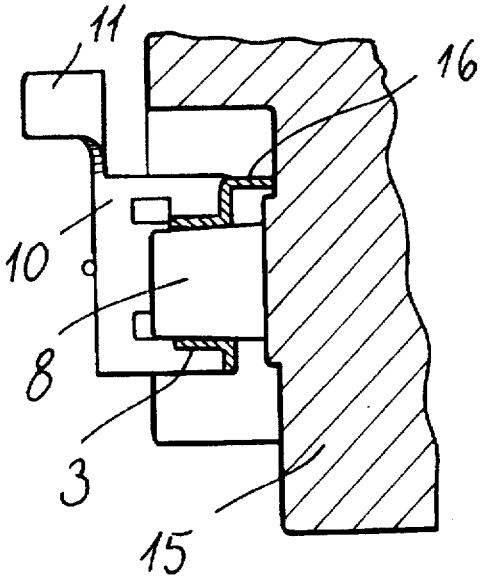
FIG. 8 is a cross-sectional view of FIG. 5, substantially taken along the section line VIII—VIII thereof.
Figure 7:
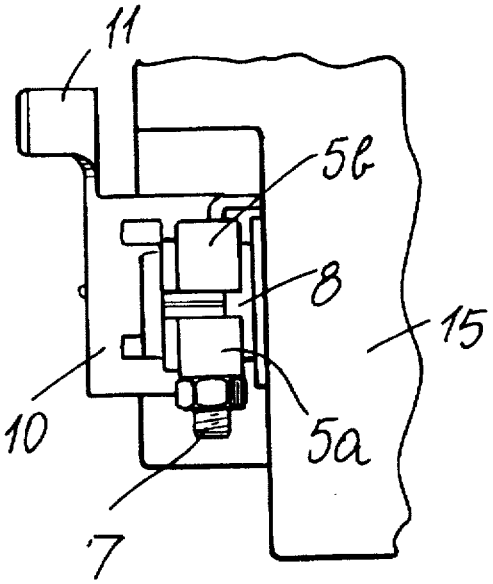
FIG. 7 is a side elevation view of the clamp shown in FIG. 5.
Figure 6:
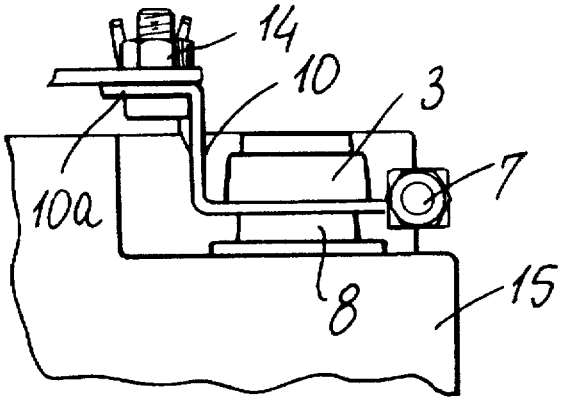
FIG. 6 is a front elevation view of the clamp shown in FIG. 5.
Figure 5:
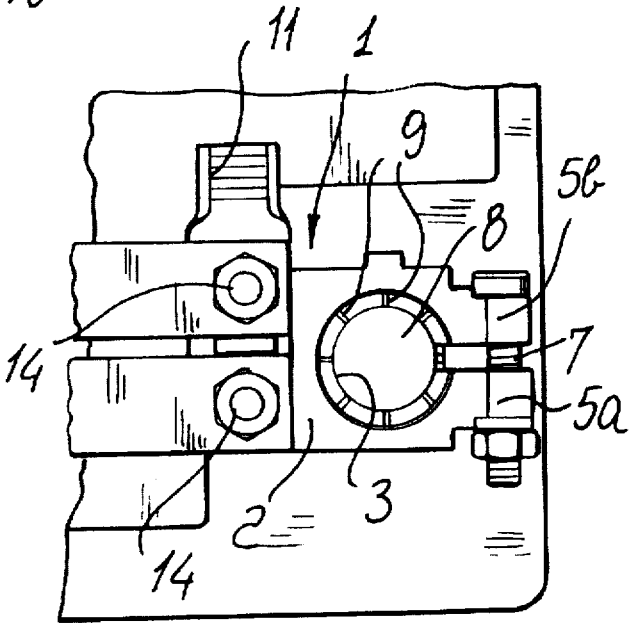
FIG. 5 is a top plan view of the clamp, as applied to the post of a battery.

In this connection it should be moreover pointed out that the central region 2 is provided, laterally, with a resting foot element 16 extending downwardly and provided for bearing, as shown in particular in FIGS. 7 and 8, on the top face of the battery 15, near the pole 8 thereof.

The clamp according to the present invention, moreover, can be used both as a clamp for the positive post of the battery, and as a clamp for the negative post of said battery, by simply changing the affixing hole for affixing the clamp on the battery post, whereas, by reversing the clamping bolt 7, the clamp can also be used as both a right or left clamp.

From the above disclosure and from the observation of the figures of the accompanying drawings, it should be apparent that the invention fully achieves the intended aim and objects, since a clamp has been provided which has the required functional features, while providing a minimum impact on the environment, owing to the use of a tinned brass material instead of the conventionally used lead material.

A further advantage of the invention is that of a significative weight reduction, from 25% to 35% with respect to a conventional diecast lead alloy clamp.

It should be apparent that the size of the clamp can be any, depending on requirements and the intended technical application.

I claim:

1. A battery post connecting clamp, wherein said connecting clamp is made in a single piece by shearing and cold bending a tinned brass material, said clamp comprising a central portion therefrom extends a mantle provided with a seat for receiving a post of a battery, said mantle being cut off at a portion thereof therefrom extend two opposite legs defining a passage for receiving a clamping bolt, said mantle having an inner surface defining said seat for said post of said battery and including a plurality of spaced coined portions, wherein said clamp is moreover provided, on an opposite portion from said clamping bolt, with a laterally extending contoured leg, said contoured leg being provided with a clamping portion for receiving different cross-section electric cables and with holes for connecting terminals of further electric cables for supplying auxiliary services, and wherein said clamping portion and holes of said contoured leg are defined on a region of said contoured leg overlaying said mantle defining said seat for said post of the battery.

2. A clamp according to claim 1, wherein said brass material comprises a galvanized brass material.

3. A clamp according to claim 1, wherein said brass material is according to the standards OT67 or OT70 of the UNI Table 4894.

* * * * *